United States Patent [19]

Cartwright, Jr.

[11] 4,405,133

[45] Sep. 20, 1983

[54] PRACTICE ARROW ADAPTER SIMULATING HUNTING ARROW CHARACTERISTICS

[76] Inventor: Clifford S. Cartwright, Jr., 1612 Scott Rd., Pylesville, Md. 21132

[21] Appl. No.: 428,136

[22] Filed: Sep. 29, 1982

[51] Int. Cl.[3] ..... F41B 5/02

[52] U.S. Cl. ..... 273/419; 273/422

[58] Field of Search ..... 273/416, 419, 420, 421, 273/422

[56] References Cited

U.S. PATENT DOCUMENTS

| | | | |
|---|---|---|---|
| 1,327,545 | 1/1920 | Garnier | 244/3.24 |
| 3,138,383 | 6/1964 | McKinzie | 273/106.5 |
| 3,282,262 | 11/1966 | Skinner | 124/5 |
| 4,111,424 | 9/1978 | Schrieber et al. | 273/106.5 |
| 4,254,958 | 3/1981 | Bateman | 273/421 |

*Primary Examiner*—Paul E. Shapiro

*Attorney, Agent, or Firm*—John F. McClellan, Sr.

[57] ABSTRACT

A novel arrow system provides the advantages to hunters of practicing with hunting heads instead of the usual practice tips, without the drawbacks of hunting heads which include chewing up practice targets and breakage of blades, and without the drawbacks of practice tips which include different sight picture, different flight pattern, and different adjustment of the bow system; the novel system provides a screw-on body to fit most arrow shafts and which may resemble practice tips except for a detent portion, and fitting over the body in snap-on engagement with the detent, a bladed-sleeve; when an arrow with this system strikes a target such as hay-bale the body penetrates as usual but the bladed-sleeve remains at the surface of the target and does not slice into it; this feature is also a safety advantage.

8 Claims, 6 Drawing Figures

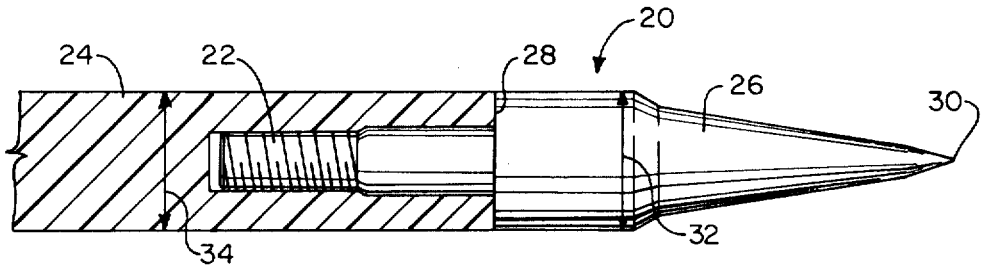
FIG. 1 KNOWN ART
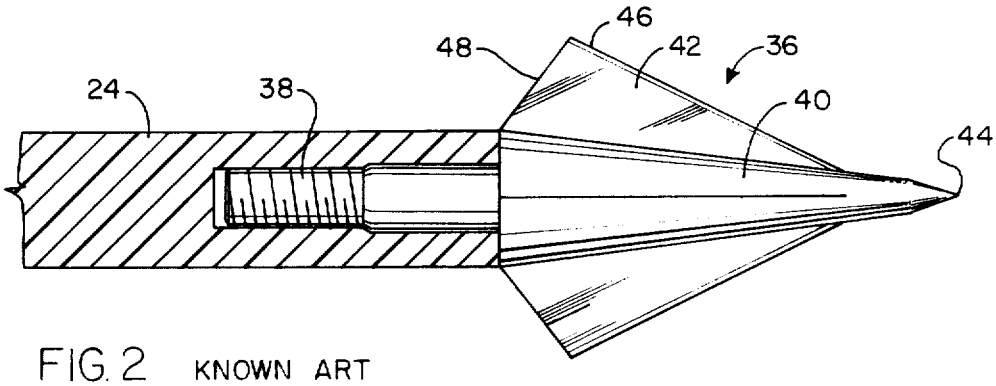
FIG. 2 KNOWN ART
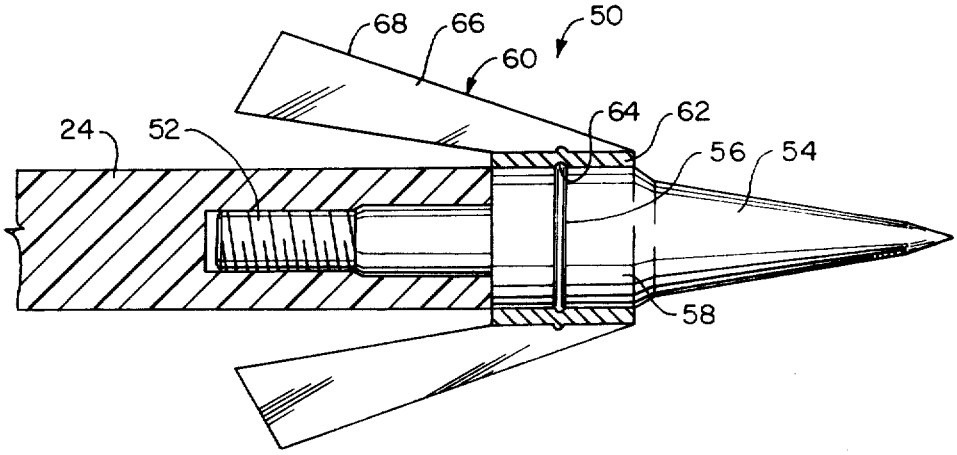
FIG. 3

PRACTICE ARROW ADAPTER SIMULATING HUNTING ARROW CHARACTERISTICS

FIELD OF THE INVENTION

This invention relates generally to archery and specifically to arrows.

BACKGROUND OF THE INVENTION

The invention is directed to solution of a problem well-stated in U.S. Pat. No. 3,138,383 issued to A. P. McKinzie on 6-23-64, and disclosing pivotal blade arrowheads.

Edited, passages apply to the present invention:

"During recent years the art of hunting game with a bow and arrow has become more and more popular. Certain states have even acted to encourage hunting of this type by providing a lengthened open season for the hunting of deer and other such game with a bow and arrow. Hunting of this type naturally takes considerable skill and practice. Persons who are adept at hunting in this manner usually spend may hours in practice shooting to develop the necessary skill and speed.

One of the obstacles which has been encountered lies in the fact that under normal circumstances a different type of arrow is used for hunting than is normally used for practice. Hunting arrows are usually equipped with pointed blades having diverging sharpened edges so as to penetrate into the game to the desired extent. However, blades of this type are not normally used for practice shooting in view of the destruction which they cause to targets. There is also a considerable danger of injuring the arrowhead or dulling the blades. However, the use of other arrows as practice arrows sometimes creates difficulty because the weights of the arrows may vary, and the flight characteristics of the arrow might also vary. Accordingly, it is the object of the present invention to provide a dual purpose arrow which may be used either as a hunting arrow or for practice."

PRIOR ART

In the prior art arrowheads with retractable blades are known. Arrows with slide-back structures are also known. U.S. Pat. No. 3,282,262 issued to J. C. Skinner on 11-1-66 disclosed an arrow with a sponge rubber depth gauge adjustably mounted on the shaft which allowed the arrow to penetrate the target only to the desired depth. U.S. Pat. No. 4,111,424 issued to R. E. Schreiber on 9-5-78, disclosed an arrow having a base slidable rearwardly along the arrow in flight (or when striking a target presumably).

SUMMARY OF THE INVENTION

However, as noted, a principal object of this invention is to provide a practice arrow system which gives, through the configuration, the same sight picture and weight and flight characteristics of a hunting arrow but which will not chew up practice targets such as hay or straw bales, which is easily retracted from practice targets and is resistant to damage of the blades.

Further objects are to provide an arrow system which is readily adaptable to standard arrow shafts and to screw-in tips.

Yet further objects are to provide a practice arrow system which is safe, economical, durable, attractive in appearance, simple and easy to use, and safer than broadheads for practice use.

BRIEF DESCRIPTION OF THE DRAWINGS

The above and other objects and advantages of this invention will become more readily apparent on examination of the following description, including the drawings in which like reference numerals refer to like parts.

FIG. 1 is a detail in side elevational and partial sectional view of a conventional practice or target tip on an arrow shaft;

FIG. 2 is a detail in side elevational view in partial section of a hunting head or broad head or hunting tip, on an arrowshaft;

FIG. 3 is a detail in side elevational view in partial section of a practice hunting tip according to this invention, installed on an arrow shaft;

DETAILED DESCRIPTION

KNOWN ART

Figure 4:
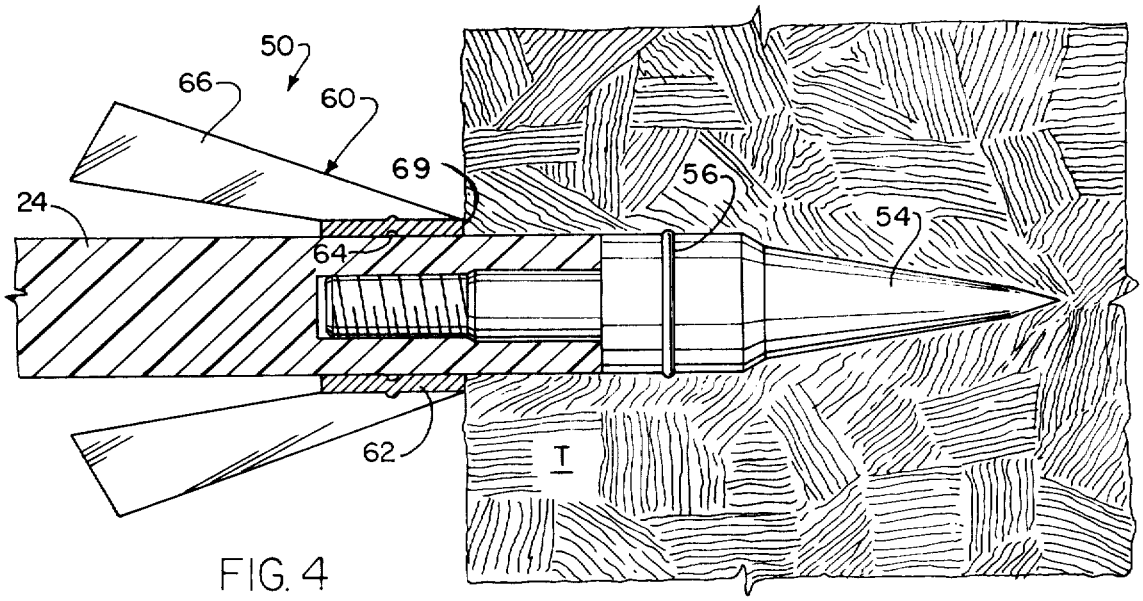
FIG. 4 is a detail in side elevational view in partial section of the practice hunting tip after impact with a hay bale target.

FIG. 1 shows a representative known art metallic practice tip 20 conventionally screwed by an axial threaded portion 22 into the forward end of a conventional arrow shaft 24, which may be of fibre-glass.

The threads draw the shoulder of the fore-body 26 of the practice tip against the forward 28 end of the shaft. The fore-body 26 of the practice tip is generally bullet shaped with a sharp end 30 and with the major diameter 32 equal to the shaft diameter 34 for snag-free withdrawal from practice targets. It may have a conical step as shown.

Practice tips are small and are simple and compact in the sight picture when an archer is aiming. They are lighter than hunting heads and travel without the airfoil interaction with the air caused by the blades of hunting heads. They are easy to withdraw and do little damage to practice targets such as hay bales.

FIG. 2 shows a representative hunting head or hunting tip or broadhead 36 similarly attached by an axial, threaded portion 38, extending from the tapered fore-body 40, to an arrow shaft 24.

The hunting head has two or more razor sharp radial blades 42 typically (this model has four) and a sharp end 44. Each blade may have a swept-back outer edge 46 more readily to slide into and injure game, and practice targets as well, both going in and when withdrawn. Each blade trailing edge 48 may be clipped as shown, or may extend to the rear as a barb, if desired.

THE INVENTION

FIG. 3 shows embodiment 50 of a practice hunting tip according to this invention installed on a arrow shaft 24 by means of axial threaded portion 52 drawing the shoulder of the body 54 against end of the arrow shaft 24 as described above.

The practice hunting tip 50 is a two-part assembly. The inner part of body 54 may be like a conventional practice tip as described above except that it has means 56 for detachably engaging the outer part, such as a roll-formed annular protrusion around the cylindrical portion 58 of the body.

The practice hunting tip outer part or bladed sleeve 60 may comprise a metallic cylindrical tube 62 slidably fitting the cylindrical portion 58 of the inner part and detachably engaging it as by means of a roll-formed annular recess 64 around the bore of the tube, and has radial blades 66 integral with the tube exterior. The blades 66 may be two or more, as desired to simulate a particular type hunting head, and may sweep back rearwardly as at 68, preferably beyond the fore-body and may be nearly in contact with the shaft for compactness.

Area and weight and sight picture and flight characteristics are by design practically the same as those of the hunting head simulated. The blades preferably are dull, not sharp.

FIG. 4 shows that the inner part or body 54 of the invention penetrates a practice target T normally and can be pulled free with little effort and little damage to the practice target. This is because on impact the practice target T strips the "pop loose" outer part 60 or bladed sleeve back along the arrow shaft 24 so that the blades do not penetrate or chew-up the practice target.

The front edge 69 of the tube 62 offers sufficient resistance to penetration, as well as the dull leading edges of the blades, to counter the low-momentum of the outer part.

To restore the bladed sleeve to use position it is only necessary to extract the arrow and snap the detent structure or annular recess 64 of the outer part onto the annular protrusion 56 of the inner part. This detent structure also serves to prevent the outer part from getting pulled off the front end when the arrow is pulled out of loose grass or such which might snag the blades 66.

Thus the detent structure and bladed sleeve are means adapting the practice tip and any arrow on which mounted for simulating a hunting tip and hunting arrow.

Figure 5:
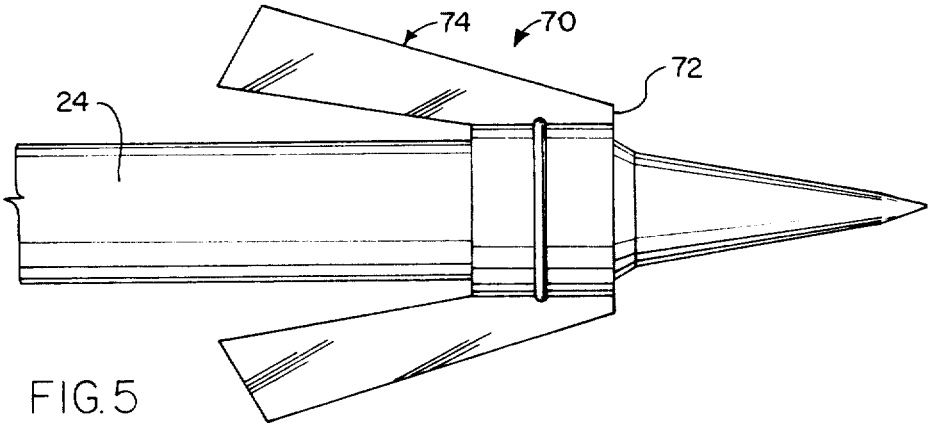
FIG. 5 is a detail in side elevational view of a further embodiment of the practice hunting tip.

FIG. 5 shows an embodiment 70 in which each blade has ahead of the sweepback a dull leading edge portion 72 substantially perpendicular to the axis of the arrow. This provides even greater resistance to target penetration by the bladed sleeve 74.

Figure 6:
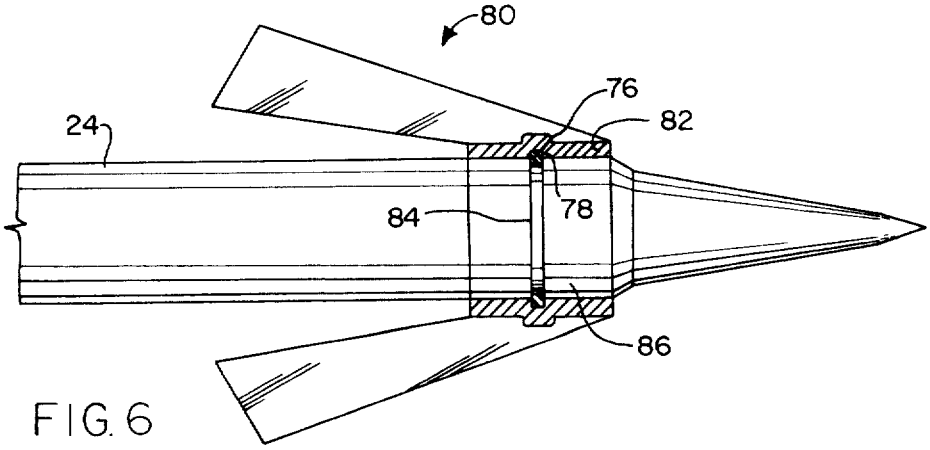
FIG. 6 is a detail in side elevational view in partial section of yet another embodiment of the practice hunting tip.

FIG. 6 shows that in an embodiment 80 a ring 76 such as a "Nylon" ring can be installed in an annular groove 78 in the tube 82 and engage a similar annular groove 84 in the inner part or body 86 for detachable retention of the outer part to the inner part. The "Nylon" ring may be proportioned to provide frictional resistance to travel along the arrow shaft 24 to limit any unwanted extra rearward travel. Normally the deceleration of stopping would limit such travel in any case.

From the above it will be appreciated that the body of the invention may be simply a practice tip with detent structure formed in it, or a specially made tip which may be called a practice tip. Either the tube may in-part protrude inwardly into a groove in the body or the body may in-part protrude outwardly into a groove in the tube, or each may do each or other detent structure may be used without departing from the spirit of invention.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A system for use with an arrow having a shaft with a forward portion, comprising a practice tip for shooting into a practice target, means for securing the practice tip to a said forward portion, means adapting said practice tip for simulating a hunting head, and means preventing said means adapting from embedding in said practice target with the practice tip.

2. A system as recited in claim 1, the means adapting comprising a bladed structure on said practice tip, and the means preventing comprising means securing the bladed structure to the practice tip detachably for travel rearwardly on a said shaft relative to the practice tip upon penetration of a target by the practice tip.

3. A system as recited in claim 2, the bladed structure comprising a bladed sleeve.

4. A system as recited in claim 3, the means securing comprising annular detent structure.

5. A system as recited in claim 3, the bladed sleeve having a front portion resistant to penetration of a practice target.

6. A system as recited in claim 2, said bladed structure including a dull blade.

7. A system as recited in claim 2, said bladed structure including at least one blade having a leading edge substantially perpendicular to said shaft.

8. A system as recited in claim 1, said simulating being simulation in configuraion forming a sight picture, simulation in weight, and simulation in flight characteristics.

* * * * *